United States Patent [19]

Jaworski

[11] 4,137,892

[45] Feb. 6, 1979

[54] HOLSTER-SHAPED DEVICE FOR FIRING PROJECTILES

[75] Inventor: Eugene Jaworski, Park Ridge, Ill.

[73] Assignee: Marvin Glass & Associates, Chicago, Ill.

[21] Appl. No.: 825,194

[22] Filed: Aug. 17, 1977

[51] Int. Cl.[2] ..... F41B 7/00

[52] U.S. Cl. ..... 124/10; 224/2 B; 124/49; 124/41 R; 46/1 E

[58] Field of Search ..... 124/10, 16, 17, 31, 124/41 R, 49, 79, 80, 1; 46/1 E; 224/2 B

[56] References Cited

U.S. PATENT DOCUMENTS

| | | | |
|---|---|---|---|
| 2,816,536 | 12/1957 | Profitt | 124/10 |
| 2,960,790 | 11/1960 | Pullen | 46/1 E |

FOREIGN PATENT DOCUMENTS

| | | | |
|---|---|---|---|
| 1081204 | 6/1954 | France | 124/10 |

*Primary Examiner*—Richard C. Pinkham
*Assistant Examiner*—William R. Browne
*Attorney, Agent, or Firm*—Mason, Kolehmainen, Rathburn & Wyss

[57] ABSTRACT

An amusement device simulating a holster for attachment to a belt or to the waistband of a garment. The holster retains a number of projectiles such as ping pong balls and projects the projectiles from the front of the holster each time the side of the holster is contacted by a force such as being hit or slapped with the palm of the hand by a game player.

14 Claims, 5 Drawing Figures

HOLSTER-SHAPED DEVICE FOR FIRING PROJECTILES

SUMMARY OF THE INVENTION

This invention relates to amusement devices and, more particularly, to a projectile firing holster attaching to a belt or a waistband of a garment and utilized by the wearer to simulate a fast draw. The holster projects a projectile each time the side of the holster is hit or slapped. The holster is a generally hollow enclosure at least a portion of which is flexible and includes a belt attachment clip and a front projection opening. A number of projectiles, ping pong balls for example, are loaded through an opening in the top of the holster enclosure and retained within the holster through the provision of a front support arm, two spaced elongated projector members and a rearward support rod carrying the projector members. When the holster is slapped, the projector members deform toward each other at a point intermediate a common pivot point and the retained projectile thereby exerting force on the retained projectile and projecting the projectile from the front opening of the holster.

DESCRIPTION OF THE PREFERRED EMBODIMENT

Figure 1:
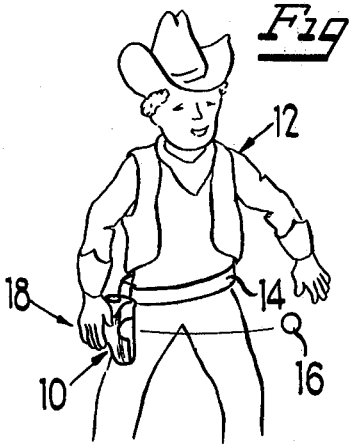
FIG. 1 is a perspective view of the holster amusement device of the present invention as worn by a game player.
Figure 2:
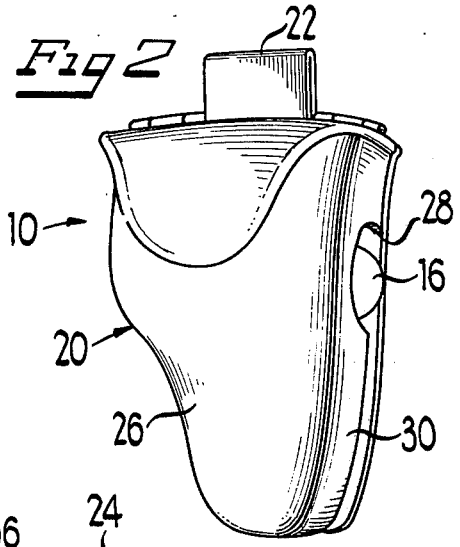
FIG. 2 is an enlarged perspective view of the holster amusement device.

The preferred embodiment of the present invention in the form of a holster-shaped device is generally designated 10, referring to FIGS. 1 and 2, and is worn by a game player 12. The holster amusement device 10 is attached to a belt or waistband 14 of a game player 12 and fires or projects a projectile 16 upon being slapped or hit by the game player such as by the slapping action from the palm of the game player's hand in a direction indicated at 18.

Figure 5:
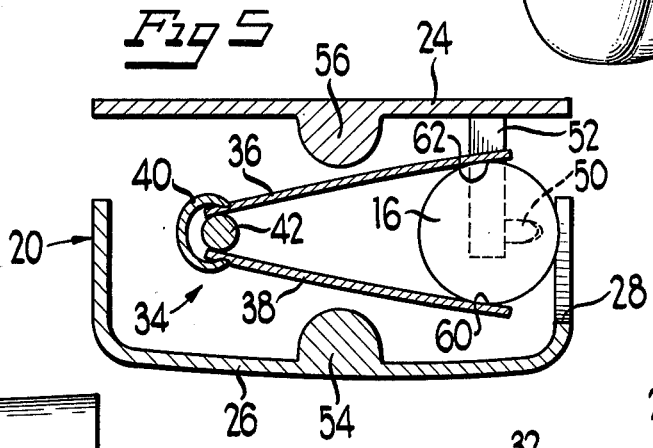
FIG. 5 is an enlarged top view partly in section of the holster amusement device of FIG. 2.
Figure 3:
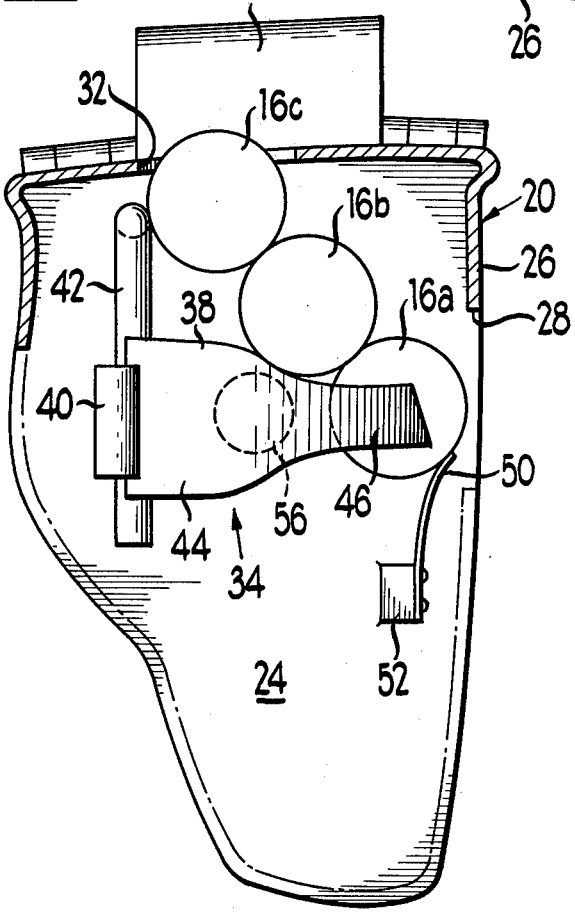
FIG. 3 is an enlarged view partly in section of the holster amusement device of FIG. 2.
Figure 4:
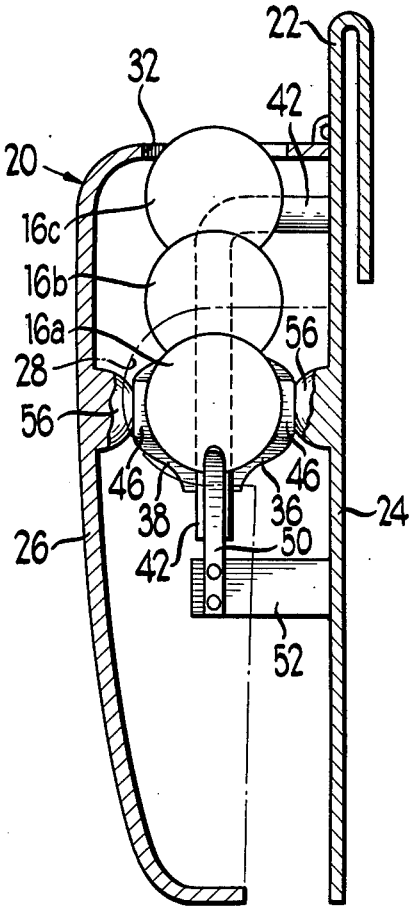
FIG. 4 is an enlarged front view partly in section of the holster amusement device of FIG. 2.

Referring now additionally to FIGS. 3, 4 and 5, the holster amusement device 10 includes a generally holster-shaped enclosure 20 with an extending generally U-shaped attachment clip portion 22 designed to interfit over the belt or waistband 14 of a garment. The enclosure 20 in a specific embodiment is fabricated with and defined by a generally upstanding rigid planar sidewall 24 to which a holster-shaped flexible molded body 26 is attached. The U-shaped attachment clip portion 22 is fabricated as an extending portion of the rigid sidewall 24. The rigid sidewall 24 fits against the game player's torso or hip when the holster amusement game device 10 is in position. A projectile opening 28 is provided in the front edge 30 of the enclosure 20 through which the projectiles 16 are projected.

A number of projectiles for example the ping pong balls **16*a*, 16*b* and 16*c* (FIG. 3) are loaded into the holster-shaped enclosure 20 through a top opening 32. The projectiles 16 are retained before being projected within the enclosure 20 by a retaining and projecting arrangement referred to generally at 34** defining a predetermined number of projectile retention positions.

The retaining and projecting arrangement 34 includes two spaced elongated resilient projector members 36 and 38 which are widely spaced toward the front edge 30 of the holster-shaped enclosure 20 and are attached by a pivot clamp member 40 encircling the end portions of the members 36 and 38 and a central pivot support pin 42 disposed between the end portions of the members 36 and 38. The pivot clamp member 40 has a generally semicircular cross-section. The pivot support pin 42 is a generally L-shaped elongated rod attached to the rigid sidewall 24. Each of the elongated projector members 36 and 38 include a widened vertically extending portion 44 adjacent the pivot pin 42 and a narrower portion 46 adjacent the front opening 28. The retaining and projecting arrangement 34 further includes a forward support member 50 which is an elongated strip of resilient material carried by a support arm 52 extending from the rigid sidewall 24.

The three projectile retention positions established by the retention and projecting arrangement 34 in a specific embodiment are identified in FIGS. 3 and 4 by the positions of the spherical projectiles **16*a*, 16*b* and 16*c*. The first projectile retention position 16*a* is established by the forward support member 50 providing generally vertical support to projectile 16*a* and a general side-to-side or horizontal support being provided by the forward narrowed portions 46 of the elongated projector members 36 and 38. The spherical projectile 16*a* remains in the first retention position until a sharp force from the slap of a hand is applied to the flexible sidewall 26 whereupon the spherical projectile 16*a* is projected or fired out the front opening 28** in a generally horizontal direction.

In this regard, the flexible sidewall 26 and the rigid sidewall 24 are provided with protruding contact members 54 and 56 respectively which are aligned approximately midway along the length of the projector members 36 and 38.

When the sidewall body 26 is hit (a force being applied thereto) and the sidewall 26 deforms inwardly, the protruding contact member 54 contacts and deforms the elongated projector member 38 and also transfers a force across the pivot clamp member 40 to the spaced projector member 36 which contacts protruding contact member 56 and is also similarly deformed. The deformation of the elongated projector members 36 and 38 produces a force on the side surfaces of the spherical projectile **16*a* which is fired or projected through the front opening 28. The first retention position defined by the spherical projectile 16*a* orientates the projectile such that the elongated projector members 36 and 38 contact the sphere at 60, 62 somewhat behind the center so that more than half of the sphere projects beyond the contact points 60, 62** respectively.

The second retention position **16*b* is defined by the contact on the top surfaces of the widened portions 44 of the elongated projector members 36 and 38 and by the contact with the spherical projectile 16*a* in the first retention position. The third projectile retention position 16*c* is defined by contacting at the rear with the pivot support pin 42 and the upper rearward portion of the projectile 16*b***.

Thus, the spherical projectiles **16*a*, 16*b* and 16*c* are loaded into the respective retention positions and are successively fired or projected in that respective order and are retained by the amusement game device 10 of the present invention until successive forces are applied to the flexible sidewall member 26. After the spherical projectile 16*a* in the first retention position is fired the projectile 16*b*** in the second retention position falls down or moves to the first retention position and is then fired upon a successive force or slap being applied to the holster.

Similarly, spherical projectile **16*c* in the third retention position moves to the second position and then to the first position respectively as the first two projectiles are fired or projected. Upon the firing of various numbers of projectiles 16*a*, 16*b* and 16*c* from the amusement game device 10, the spherical projectiles are then loaded through the top opening 32**.

The holster amusement device 10 may be utilized by a single individual player in connection with firing at an associated target device (not shown) or to simulate general "firing" or "fast draw" maneuvers. In another scheme of play, two or more players each wearing a holster amusement device 10 may collectively participate in "fast draw" contests or "gun fights". The "fast draw" contests may be organized by the winner of each fast draw between two players engaging in a successive contest with a new game player challenger until one winner results as the "fastest draw" among the total number of game players.

The foregoing detailed description has been given for clearness of understanding only and no unnecessary limitations should be understood therefrom, as some modifications will be obvious to those skilled in the art.

I claim:

1. An amusement device for attachment to the belt or the waistband of a game player, comprising:

a generally holster-shaped enclosure for holding a plurality of projectiles and having an inside wall and an outer sidewall with at least a portion of one of said walls being movable toward and away from the other of said walls when struck by the hand of said game player, said enclosure including a discharge opening for projectiles between said inside and outside walls; and means disposed within and carried by said holster-shaped enclosure for retaining and firing projectiles one at a time out of said discharge opening when one of said walls is depressed toward the other of said walls.

2. The amusement device of claim 1 wherein said retaining and firing means comprises a pair of spaced elongated projector members disposed on opposite sides of a projectile in position ready to be fired, a projectile being propelled out said discharge opening when said outer sidewall portion is depressed to contact one of said spaced elongated projector members.

3. The amusement device of claim 2 wherein said elongated spaced projector members are positioned to form an acute angle therebetween, and being spaced farthest apart adjacent said front discharge opening of said enclosure.

4. The amusement device of claim 2 wherein said elongated spaced projector members restrain side-to-side movement of a projectile in position ready for firing.

5. The amusement device of claim 4 wherein said retaining and firing means further comprises a forward retaining arm disposed adjacent a front portion of said enclosure providing vertical support for a projectile in a ready position.

6. The amusement device of claim 5 wherein said retaining and firing means defines a plurality of projectile retention positions, said ready position being defined between said forward retaining arm and leading portions of said elongated spaced projector members disposed adjacent said front wall of said enclosure, a projectile in said ready position being positioned adjacent said discharge opening.

7. The amusement device of claim 6 wherein a second of said projectile retention positions is defined between intermediate portions of said elongated spaced projector members and a projectile in said ready position, said elongated spaced members at said intermediate portions including a widened vertically extending portion.

8. The amusement device of claim 7 wherein a third of said projectile retention positions is defined between a projectile in said second retention position and adjacent an inlet opening in said enclosure.

9. The amusement device of claim 8 wherein said retaining and firing means further comprises a pivot clamp member interconnecting the ends of said elongated spaced members, and an elongated support member extending from said enclosure and supporting said pivot clamp member and said elongated spaced projector member, said support member aiding in retaining a projectile in said third position.

10. The amusement device of claim 8 adapted to support three projectiles loaded into said enclosure in said retention positions for successive firing upon successive forces being applied to depress said outer wall portion of said enclosure toward said inside wall, said firing being the order projectiles are retained in said projectile retention positions, a projectile in said second position rolling into said ready position after firing of a first projectile in said ready position, a projectile in said third position rolling into said second position and said ready position successively after firing of projectiles initially in said ready and second positions.

11. The amusement device of claim 1 wherein said enclosure further includes an upper wall having an inlet opening through which projectiles are loaded into retention positions therein.

12. An amusement device for attachment to the belt or the waistband of a game player, comprising:

a generally holster-shaped enclosure for holding one or more projectiles and having an inside wall and an outer sidewall with at least a portion being movable toward and away from said inside wall when struck by the hand of said game player, said enclosure including a front wall extending between said inside wall and said outer sidewall and having a discharge opening for projectiles; and means disposed within and carried by said holster-shaped enclosure for retaining and firing projectiles one at a time out of said discharge opening when said outer sidewall is depressed toward said inside wall wherein said retaining and firing means includes means providing a plurality of projectile retention positions in said enclosure.

13. An amusement device for attachment to the belt or the waistband of a game player, comprising:

a generally holster-shaped enclosure for holding one or more projectiles and having an inside wall and an outer sidewall with at least a portion being movable toward and away from said inside wall when struck by the hand of said game player, said enclosure including a front wall extending between said inside wall and said outer sidewall and having a discharge opening for projectiles; and means disposed within and carried by said holster-shaped enclosure for retaining and firing projectiles one at a time out of said discharge opening when said outer sidewall is depressed toward said inside wall wherein said retaining and firing means comprises a pair of spaced elongated projector members disposed on opposite sides of a projectile in position ready to be fired, a projectile being propelled out said discharge opening when said outer sidewall portion is depressed to contact one of said spaced elongated projector members wherein said sidewalls of said enclosure include protuberances aligned with and contacting said elongated spaced projector members upon depression of said outer sidewall portion toward said inside wall.

14. An amusement device for attachment to the belt or the waistband of a game player, comprising:

a generally holster-shaped enclosure for holding one or more projectiles and having an inside wall and an outside wall with at least a portion of one, said walls being movable toward and away from the other of said walls when struck by the hand of said game player, said enclosure including a discharge opening for said projectiles; and means disposed within and carried by said holster-shaped enclosure for retaining and firing projectiles one at a time out of said discharge opening when one of said walls is depressed toward the other of said walls, wherein said retaining and firing means comprises a pair of spaced elongated projector members disposed on opposite sides of a projectile in position ready to be fired, wherein said sidewalls of said enclosure include protuberances aligned with said elongated spaced projector means, a projectile being propelled out said discharge opening when said protuberances contact said spaced elongated projector members upon movement of one of said wall portions toward the other of said wall portions.

* * * * *